US008714922B2

(12) United States Patent
Twell

(10) Patent No.: US 8,714,922 B2
(45) Date of Patent: May 6, 2014

(54) DIFFUSER FOR DECELERATING A COMPRESSED FLUID

(75) Inventor: Philip Twell, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 1178 days.

(21) Appl. No.: 12/523,071

(22) PCT Filed: Jan. 24, 2008

(86) PCT No.: PCT/EP2008/050825

§ 371 (c)(1),
(2), (4) Date: Jul. 14, 2009

(87) PCT Pub. No.: WO2008/090202

PCT Pub. Date: Jul. 31, 2008

(65) Prior Publication Data

US 2010/0037616 A1 Feb. 18, 2010

(30) Foreign Application Priority Data

Jan. 25, 2007 (GB) ..... 0701371.7

(51) Int. Cl.
*F01D 9/04* (2006.01)

(52) U.S. Cl.
USPC ..... 415/210.1

(58) Field of Classification Search
USPC ..... 416/212 R, 212 A; 415/224.5
See application file for complete search history.

(56) References Cited

U.S. PATENT DOCUMENTS

| | | | | |
|---|---|---|---|---|
| 2,570,155 | A | 10/1951 | Redding | |
| 4,990,056 | A * | 2/1991 | McClain et al. | 415/160 |
| 5,154,581 | A * | 10/1992 | Borufka et al. | 416/190 |
| 5,238,364 | A * | 8/1993 | Kreitmeier | 415/173.1 |
| 6,425,738 | B1 | 7/2002 | Shaw | |
| 6,513,330 | B1 | 2/2003 | Froemming | |
| 7,101,086 | B2 * | 9/2006 | Klier | 384/273 |
| 2004/0067131 | A1 * | 4/2004 | Joslin | 415/139 |
| 2009/0274562 | A1 * | 11/2009 | Minor et al. | 416/241 R |

FOREIGN PATENT DOCUMENTS

| | | | |
|---|---|---|---|
| CN | 1116271 | A | 2/1996 |
| EP | 1010945 | A2 | 6/2000 |
| FR | 2706533 | A1 | 12/1994 |
| FR | 2880391 | A1 | 7/2006 |
| GB | 960812 | A | 6/1964 |
| GB | 967940 | A | 8/1964 |
| GB | 967949 | A | 8/1964 |
| GB | 1211313 | A | 11/1970 |
| GB | 2251034 | A | 6/1992 |

(Continued)

*Primary Examiner* — Nathaniel Wiehe
*Assistant Examiner* — Jeffrey A Brownson

(57) ABSTRACT

A diffuser for decelerating a compressed gas, is provided, which includes a ring divided at circumferential positions around the ring into several arcuate sections, the complete ring is assembled from these sections. The ring defines one or more passages, the cross-section of which increases in the direction of flow of a fluid through the diffuser. The interface between adjacent sections is configured so that relative movement between the sections is prevented. The interface is configured to have a series of interlocking serrations along the axial length of the diffuser. In an embodiment, there are two arcuate sections involving two interfaces, and the peaks and troughs of the serrations of each of the two sections are arranged at an angle to a longitudinal axis of the diffuser. A small relative movement between the sections is achieved when the two angles at the two interfaces have opposite signs.

20 Claims, 8 Drawing Sheets

(56) References Cited

FOREIGN PATENT DOCUMENTS

| | | | |
|---|---|---|---|
| GB | 2397373 | A | 7/2004 |
| GB | 2397373 | B | 9/2005 |
| IT | 1165027 | B | 4/1987 |
| JP | 2003214180 | A | 7/2003 |
| WO | WO 2008090202 | A1 | 7/2008 |

* cited by examiner

VIEW @ 45°

TOP VIEW

DIFFUSER FOR DECELERATING A COMPRESSED FLUID

CROSS REFERENCE TO RELATED APPLICATIONS

This application is the US National Stage of International Application No. PCT/EP2008/050825, filed Jan. 24, 2008 and claims the benefit thereof. The International Application claims the benefits of Great Britain application No. 0701371.7 GB filed Jan. 25, 2007, both of the applications are incorporated by reference herein in their entirety.

FIELD OF INVENTION

The present invention relates to a diffuser for decelerating a compressed fluid.

BACKGROUND OF INVENTION

Diffusers are used in order to condition the compressed fluid (usually air) of a gas-turbine engine before it is fed to the combustor, where it is mixed with fuel, the resultant mixture being used to drive the turbine.

A typical gas-turbine engine with a diffuser is shown in FIG. 1 in simplified form. This diagram is taken from U.S. Pat. No. 6,513,330, issued on 4 Feb. 2003 and assigned to the Allison Advanced Development Company.

The engine shown as reference numeral 10 in FIG. 1 is a turbo-fan engine for an aircraft and comprises a fan section 12, a compressor section 14, a combustor section 16 and a turbine section 18. The compressor section 14 includes a rotor 20, which has coupled to it a series of compressor blades 22. The rotor 20 is secured to a shaft 24, which rotates within the engine. A plurality of compressor vanes 26 are disposed next to the blades 22 and serve to direct the flow of gaseous fluid through the compressor section. At the downstream end of the compressor section is a number of compressor outlet vanes 26' for directing the flow of fluid into an annular diffuser 28. As mentioned above, the diffuser conditions the fluid and discharges it into the combustor section for subsequent combustion.

Typically, a diffuser may be made in two halves, which fit together to form a ring. Thus the two halves are arcs of a circle. When the diffuser is fitted, the lower half is attached to the lower part of the engine, then the rotor is fitted, then the upper half of the diffuser is offered up to the lower half over the rotor, finally the upper part of the engine is offered up to the lower part of the engine and secured thereto in a manner which also clamps the two diffuser halves together. While this sounds like a relatively simple process, in practice it is complicated by the difficulty experienced in keeping the two halves of the diffuser in proper alignment with each other while the rotor is being fitted and the upper part of the engine is attached. Any relative movement between the two halves of the diffuser at this time may result in the diffuser halves being permanently misaligned, with consequent reduction in diffuser performance.

SUMMARY OF INVENTION

The present invention has been developed with a view to mitigating the above drawback with the known diffuser arrangements.

In accordance with a first aspect of the invention there is provided a diffuser for decelerating a compressed fluid, comprising a ring arrangement, which is divided at circumferential positions around the ring arrangement into a plurality of arcuate sections, which arcuate sections are assembled together to form the ring arrangement, wherein: the ring arrangement defines one or more passages, and the interface between adjacent arcuate sections is configured such as to prevent relative movement of the adjacent sections.

The interface is advantageously formed by a serrated mating surface of the adjacent arcuate sections. The serrations may be configured at an angle to the longitudinal axis of the diffuser.

There may be two adjacent arcuate sections providing two pairs of mating surfaces disposed on respective sides of the longitudinal axis, the angle $\alpha$ of the peaks and troughs of the serrations in one pair of mating surfaces with respect to the longitudinal axis being opposite to the angle $\alpha$ of the peaks and troughs of the serrations in the other pair of mating surfaces with respect to said longitudinal axis. The two interfaces and the longitudinal axis may lie on the same plane. The serrations may be triangular in shape.

The angle $\alpha$ in the pairs of mating surfaces preferably lies in the range 30° to 60° and is more preferably approximately 45°.

The angle of pitch $\beta$ of the serrations preferably lies in the range 30° to 60° and is more preferably approximately 45°.

There may be two adjacent arcuate sections providing two pairs of mating surfaces disposed on respective sides of the longitudinal axis, wherein the peaks and troughs of the serrations in the pairs of mating surfaces subtend an angle of $\alpha$=90° with respect to the longitudinal axis, and wherein the serrations are formed at an angle $\gamma$ in the plane of the diffuser.

The angle $\gamma$ in the pairs of mating surfaces preferably lies in the range 30° to 60° and is more preferably approximately 45°.

The diffuser may define a radially outer passage and a radially inner passage.

The ring arrangement may comprise a radially outer ring and a radially inner ring, which define therebetween the radially outer passage, the radially outer and inner rings being held in spaced-apart relationship by means of first vanes.

The radially inner passage may be defined, in part, by the radially inner ring, the radially inner passage being radially inside the radially inner ring.

Second vanes may be provided that depend radially inwardly from the radially inner ring.

The diffuser may define one passage only.

The ring arrangement may comprise a radially outer ring and a radially inner ring, which define therebetween the one passage, the radially outer and inner rings being held in spaced-apart relationship by means of vanes.

One or each of said arcuate sections advantageously comprises one or more projections or recesses for engagement with a corresponding recess or projection in a compressor casing.

A second aspect of the invention provides a method for producing a diffuser as described above, comprising the steps of: providing a complete ring arrangement, and dividing the ring arrangement into said arcuate sections by erosion of the ring arrangement in a generally longitudinal direction, said erosion at the same time forming said configuration of the interface between the adjacent arcuate sections.

The dividing step may form said configuration over substantially the whole of the longitudinal extent of the ring arrangement. Alternatively, the dividing step may form said configuration over one or more portions of the longitudinal extent of the ring arrangement.

The dividing step advantageously configures the interface as mating serrations or as a bird's mouth arrangement.

The dividing step may employ a wire electrical discharge machining procedure.

BRIEF DESCRIPTION OF THE DRAWINGS

Embodiments of a diffuser in accordance with the present invention will now be described, purely by way of example, with the aid of the drawings, of which.

DETAILED DESCRIPTION OF INVENTION

Figure 1:
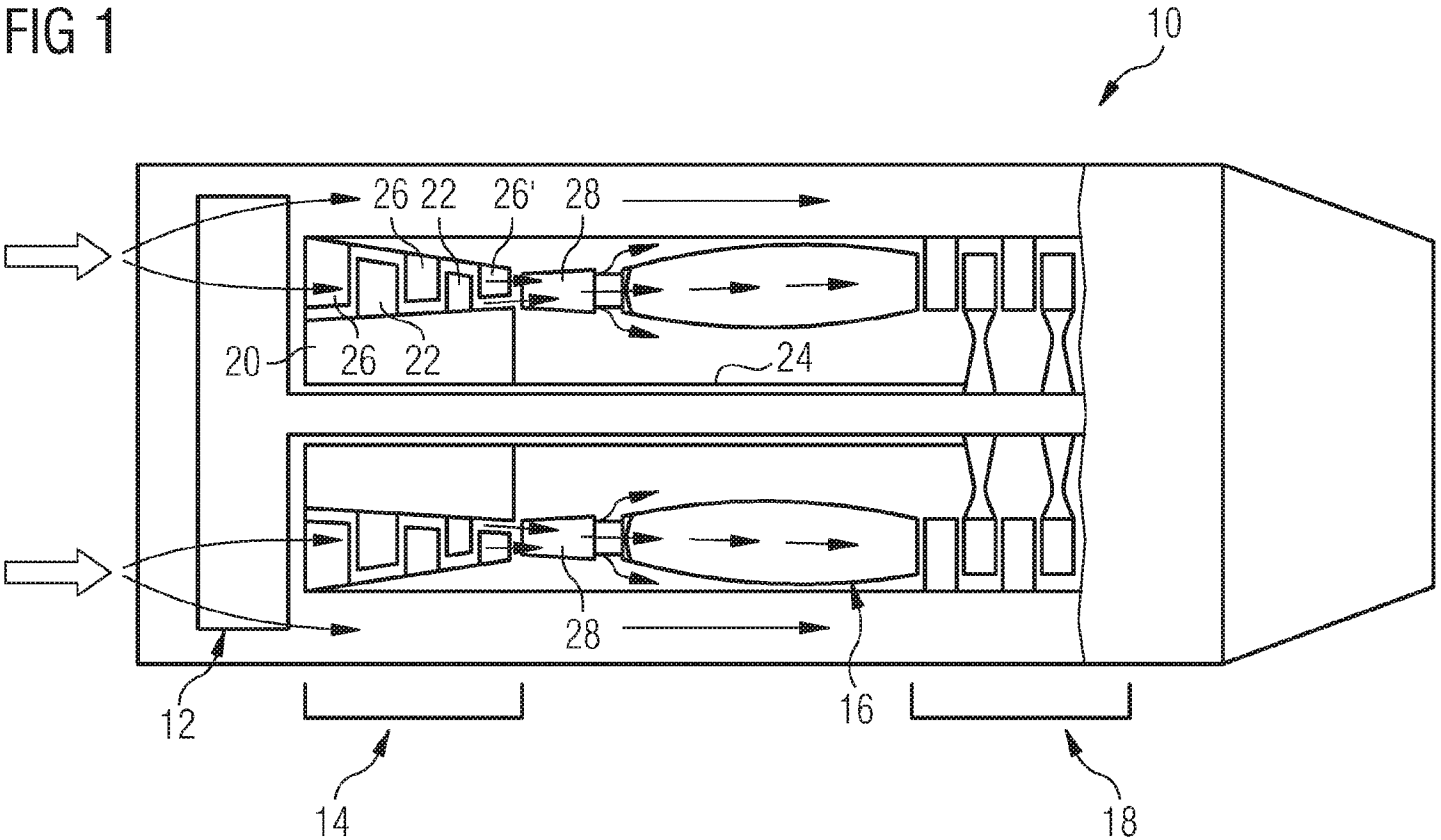
FIG. 1 is a sectional view of a known gas turbine engine.
Figure 2A:
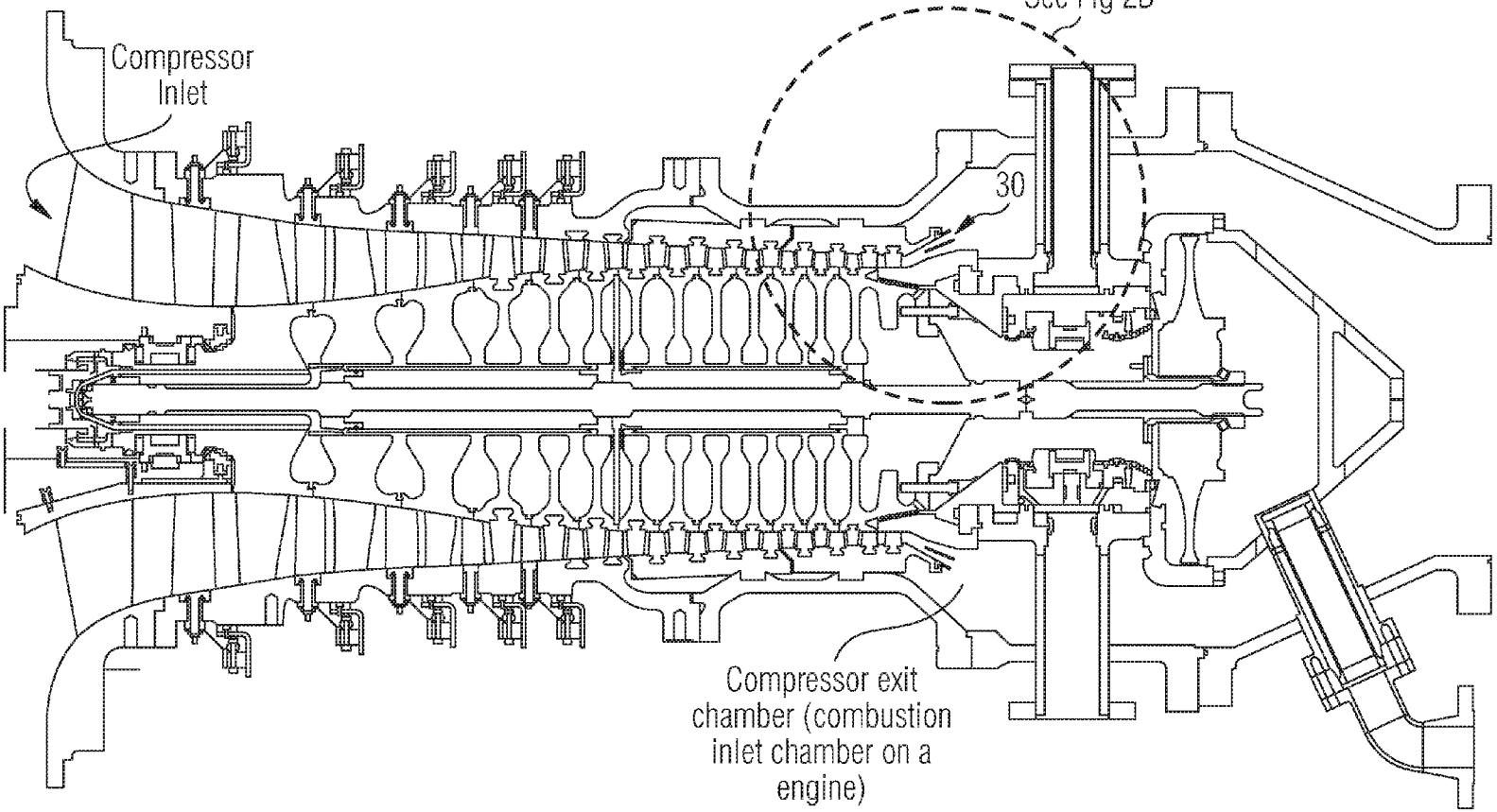
FIGS. 2(*a*) and 2(*b*) are sectional views of a gas turbine incorporating an embodiment of a diffuser in accordance with the present invention.
Figure 2B:
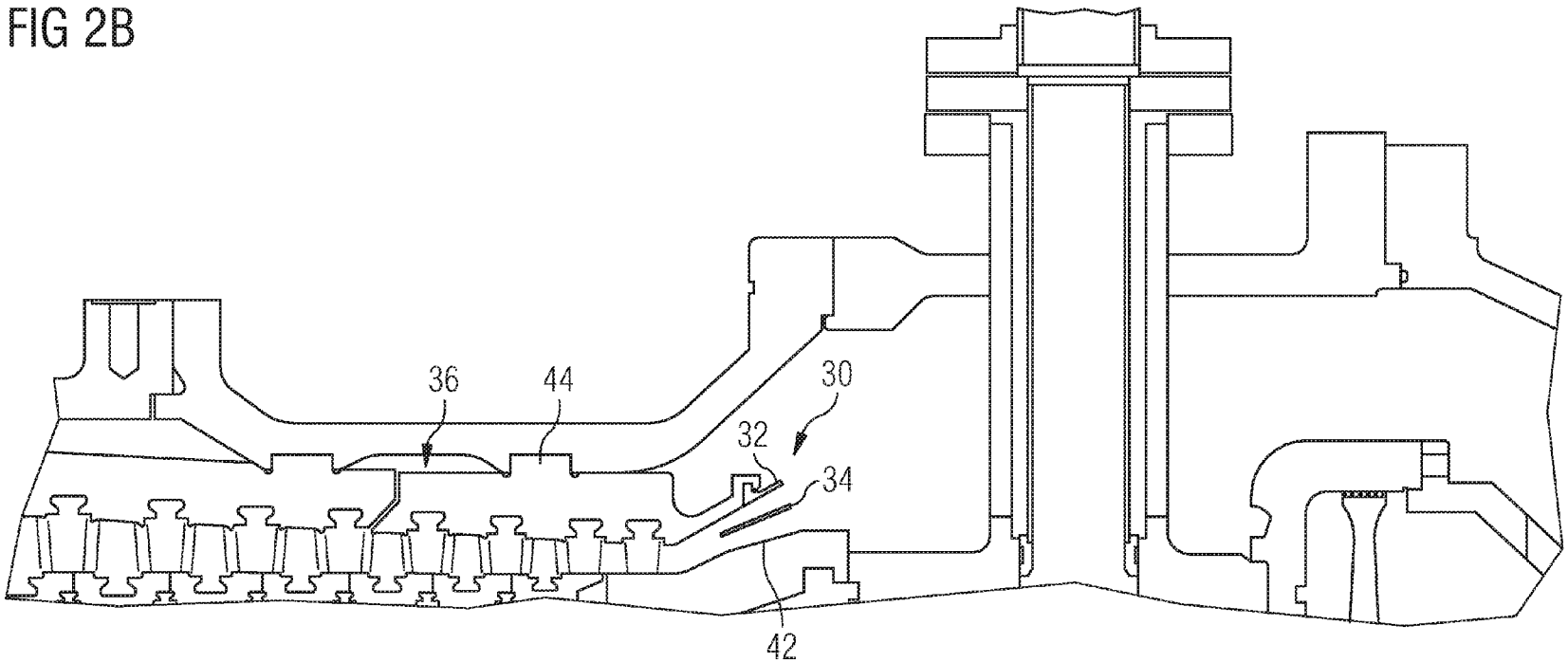

A diffuser in accordance with a first embodiment of the invention is located in a compressor as illustrated in FIGS. 2(*a*) and 2(*b*), being shown as reference numeral 30 in these drawings. The diffuser 30 is disposed in the compressor exit chamber, so that it receives compressed air leaving the compressor. The diffuser is a split diffuser, as can more clearly be seen in FIG. 2(*b*), which is a magnified version of the inset area in FIG. 2(*a*). Hence the diffuser comprises an outer ring 32 and an inner ring 34. The outer ring is attached to the rear compressor stator casing 36, while the inner ring is attached to the outer ring via a series of vanes (not shown in FIG. 2).

Figure 3B:
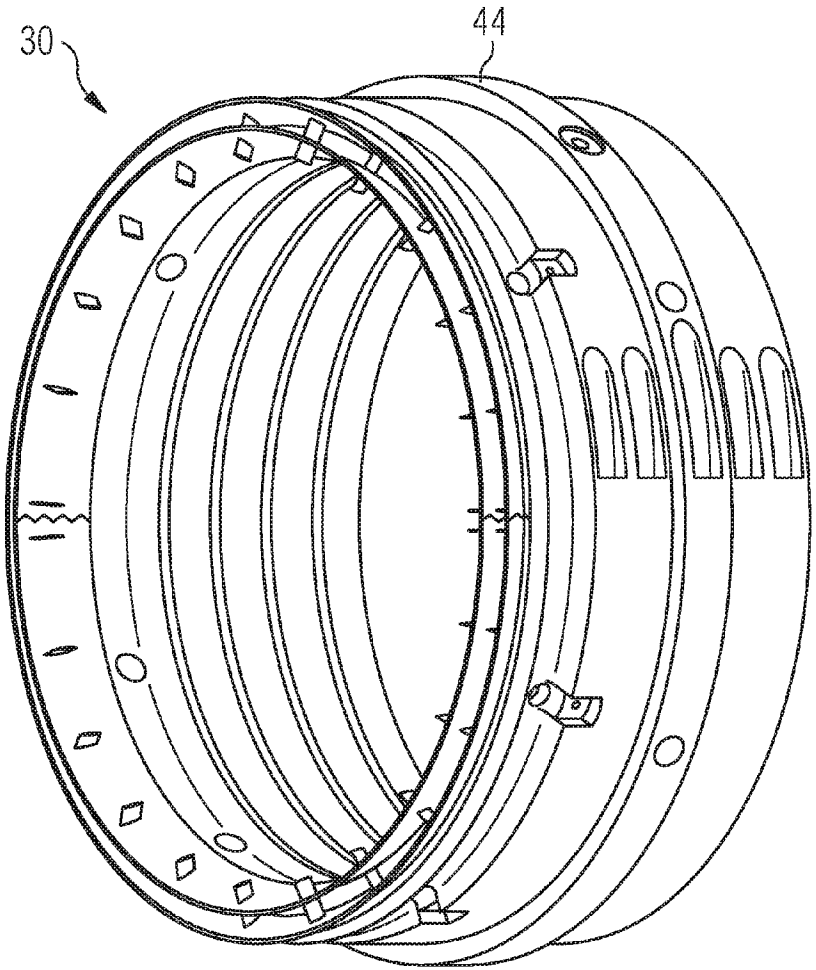
FIG. 3(*a*) is a perspective view of an embodiment of a diffuser in accordance with the present invention, and FIG. 3(*b*) shows the same diffuser mounted in its associated engine part.
Figure 3A:
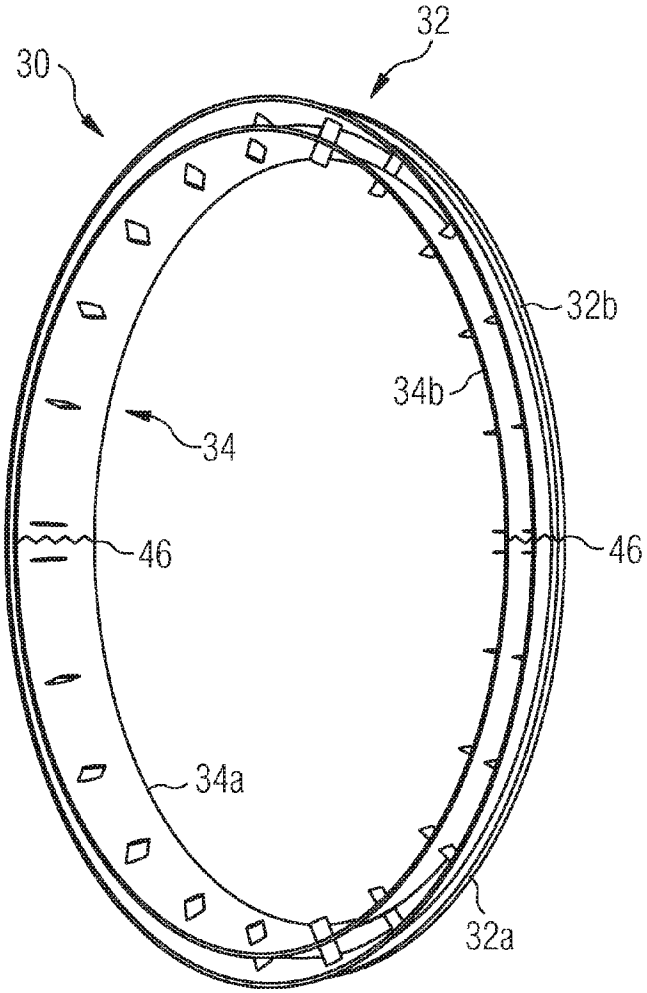

This split-diffuser arrangement is shown more clearly in FIGS. 3(*a*) and 3(*b*). In FIG. 3(*a*) the two rings 32 and 34 can be seen to be spaced apart from each other by a series of circumferentially spaced-apart vanes 38. In turn, a second series of vanes 40 depend from an inner surface of the inner ring 34. These vanes 40, in the assembled state of the engine, bear against a seal member 42 (see FIG. 2(*b*)). Thus the diffuser is held firmly between the compressor stator casing 36 and the seal member 42, thereby providing a stable and robust structure.

Figure 4:
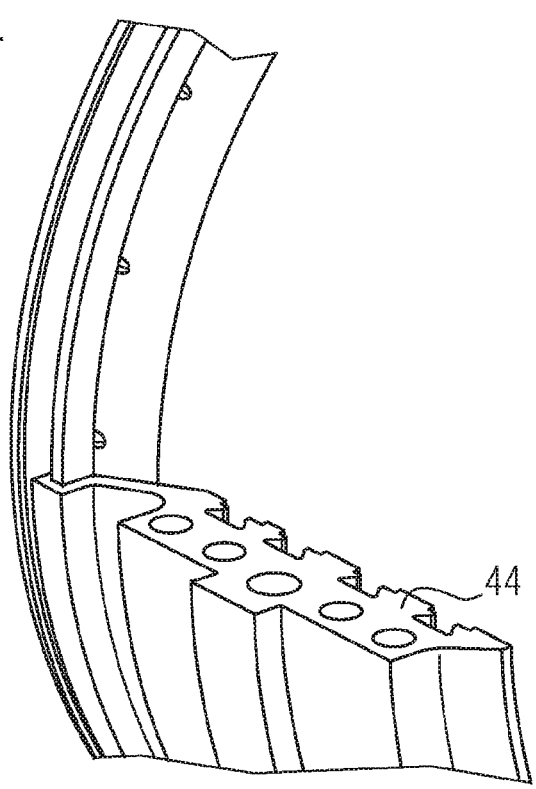
FIG. 4 is a detailed perspective view of the diffuser of FIGS. 3(*a*) and 3(*b*) mounted to a high-pressure insert.
Figure 5:
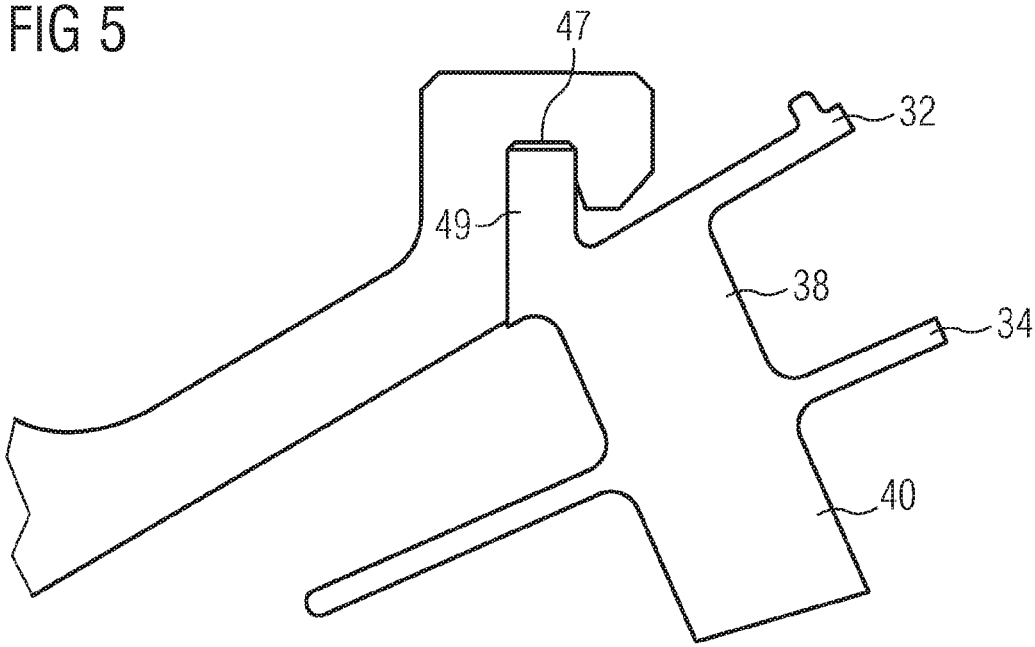
FIG. 5 is a sectional simplified view of the diffuser of FIGS. 3(*a*) and 3(*b*) mounted to the high-pressure insert.

FIG. 3(*b*) shows the diffuser 30 fitted to a high-pressure insert member 44, which forms part of the rear compressor stator casing 36 (see also FIG. 2(*b*)). This insert member is, like the diffuser, in two halves. The insert member 44 is shown looking in an upstream direction in FIG. 3(*b*), while the lower half of it is shown looking in a downstream direction in FIG. 4. FIG. 5 is a sectional view through a portion of the insert and through the diffuser in their assembled state and shows how the diffuser engages in a notch 47 provided in the insert. To this end, a lug 49 is provided in the diffuser at its radially outer end. FIG. 5 also shows the outer and inner rings 32, 34 and the two sets of vanes 38, 40.

The diffuser 30, insert member 44 and seal member 42 are all formed in two halves in order to accommodate the rotor. The two halves of the diffuser are a lower outer-ring 32*a* and inner-ring 34*a* half and an upper outer-ring 32*b* and inner-ring 34*b* half. As in the known arrangements, the lower half of the rear compressor stator casing 36, including the insert 44, is prepared; the lower half of the seal member 42 is introduced into the lower half of the rear compressor stator casing 36/insert 44; the lower half of the diffuser 30 is engaged with the lower half of the insert 44; the rotor is fitted; the upper half of the seal member 42 is fitted to the lower half of the seal member 42; the upper half of the diffuser 30 is fitted to the lower half of the diffuser 30 and the upper half of the rear compressor stator casing 36/insert 44 are fitted to the lower half of the rear compressor stator casing 36/insert 44. The last-mentioned operation involves, of course, the fitting of the lug 49 of the upper diffuser half to the notch 47 of the upper insert 44 half.

At the interface between the two halves of the diffuser there is provided a means whereby these two halves are prevented from moving relative to each other. In a preferred embodiment of the invention all movement in a radial and axial direction is prevented. This is achieved by providing a series of serrations 46 in the mating surfaces of the upper and lower halves of both the outer and inner rings 32, 34.

Figure 6B:
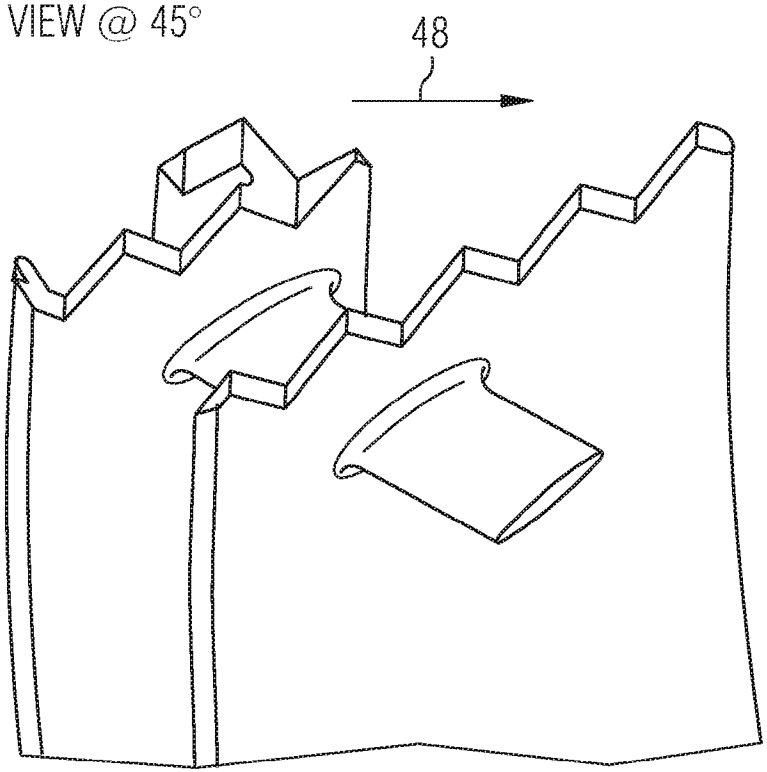
FIGS. 6(*a*) and 6(*b*) are two perspective views of the diffuser of FIGS. 3(*a*) and 3(*b*)
Figure 6A:
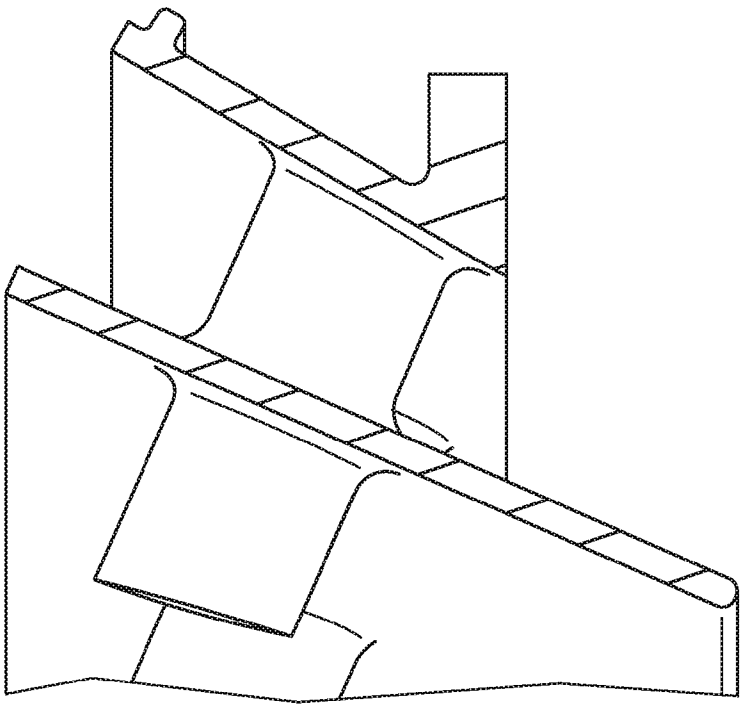
Figure 7A:
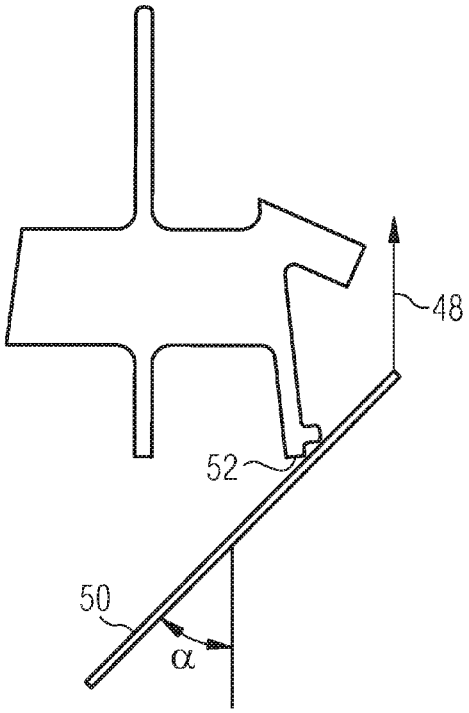
FIGS. 7(*a*) and 7(*b*) are plan and side views, respectively, of a preferred embodiment of a diffuser in accordance with the invention, and illustrating a method of forming the arcuate sections of the diffuser and at the same time configuring the interface between them.
Figure 7B:
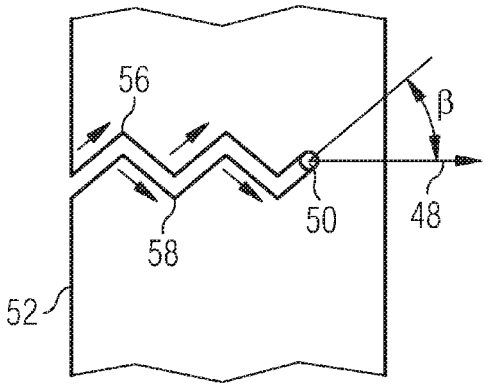

These serrations may take several forms. A preferred form is a series of triangular teeth, as shown in FIGS. 6(*a*) and 6(*b*). In the example shown, the teeth are cut along a 45° angle with respect to the axial direction of the diffuser. A convenient way of doing this is to use a wire EDM (electrical discharge machining) technique. This technique involves drawing a wire through both the outer and inner rings at the interface between their upper and lower halves in the axial direction shown by the arrow 48 (or in the opposite direction). This is more clearly seen in the plan view of FIG. 7(*a*) and the side view of FIG. 7(*b*). In FIG. 7(*a*) the wire 50 is brought up to one edge 52 of one of the outer and inner rings and is moved generally in a forward direction (see arrow 48) and at the same time in a triangular fashion, as shown in FIG. 7(*b*). The wire 50 is inclined at an angle $\alpha$ to the longitudinal axis of the diffuser. When EDM is used, it will normally be necessary to cut the outer and inner rings in tandem in one operation. Alternative cutting techniques (e.g. laser or water jet) may allow individual cutting of the outer and inner rings.

Figure 8:
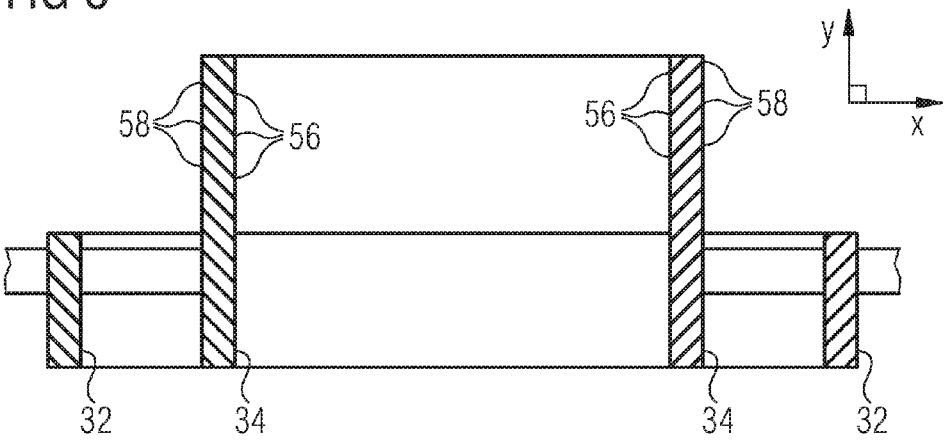
FIG. 8 is a plan view of a lower half of the preferred embodiment of the diffuser.

In a preferred embodiment, this process is repeated at the other interface, but with the angle $\alpha$ in the opposite direction—i.e. the mirror image with respect to the longitudinal axis. This configuration is illustrated in FIG. 8, in which the peaks 56 and troughs 58 shown in FIG. 7(*b*) are visible in plan view. Also shown are the outer and inner rings 32, 34. Since the wire-drawing method affects both the upper and lower halves of each interface equally, it is guaranteed that the triangular configuration will be identical for each half and that, therefore, there will be a perfect fit between the upper and lower halves. Furthermore, because the directions of cut at the two interfaces are opposite to each other, when the upper and lower halves are mated with each other, no movement in either the radial (x) direction or axial (y) direction will be possible. This means that, during assembly of the upper half of the rear compressor casing on its lower half, the two halves of the diffuser will not move relative to each other and, therefore, the desired performance of the diffuser will not be impaired.

It should be borne in mind at this point that, in practice, the orientation of the flat surfaces of the vanes 38, 40 may not be completely axial. Furthermore, the flow of the fluid passing through the diffuser may likewise not be completely axial, but may have a tangential component as well. Consequently, there may be a small tangential force acting on the diffuser causing it to move in a circumferential direction within the notch 47 of the insert member 44. This can be prevented by, for example, incorporating a pin or bolt at least one point along the circumference of the diffuser securing it to the insert. Such a pin or bolt could be disposed in the notch 47 and arranged so as to engage with a corresponding recess or female thread in the lug 49, or alternatively the lug 49 and notch 47 could be shaped so as to discourage such circumferential movement. In this case the notch 47 could be provided with a small protrusion, which engaged with a corresponding recess in the lug 49, or vice-versa.

As regards the value of the angle $\alpha$, this need not be 45°, but may be smaller or larger than this. However, a very large angle (close to 90°) with respect to the axial direction 48 will increase the risk that some relative movement in the radial direction will be possible, while a very small angle (close to 0°) with respect to the axial direction 48 will increase the risk that some relative movement in the axial direction will be possible. This still allows a wide range for angle $\alpha$. A working range may be, for example, 30°-60°, though this depends on the shape or degree of flare of the diffuser. A wide flare may restrict at least the upper end of the range, especially where the inner and outer rings have to be profiled in tandem, as in the EDM method.

As regards the angle of pitch of the teeth (angle $\beta$ shown in FIG. 7(*b*)), this is, again, advantageously about 45°, but may occupy a similar range as angle $\alpha$. A steep angle will give greater protection against slippage of one diffuser half relative to the other due to lifting of one half relative to the other, but at the cost of possibly having to provide a greater number of teeth, which could increase the manufacturing costs. On the other hand, while making angle $\beta$ shallow would reduce the number of teeth required, this could give poorer protection against inadvertent lifting of one diffuser half relative to the other and subsequent axial and/or radial relative displacement. A further factor in terms of immunity to axial or radial slippage is the relative size of the teeth in relation to the thickness of the EDM wire and the manufacturing tolerance of the parts. It is preferable if the teeth are large in relation to the wire diameter. This will then affect the number of teeth that may be accommodated along the interface between the diffuser halves.

Figure 9:
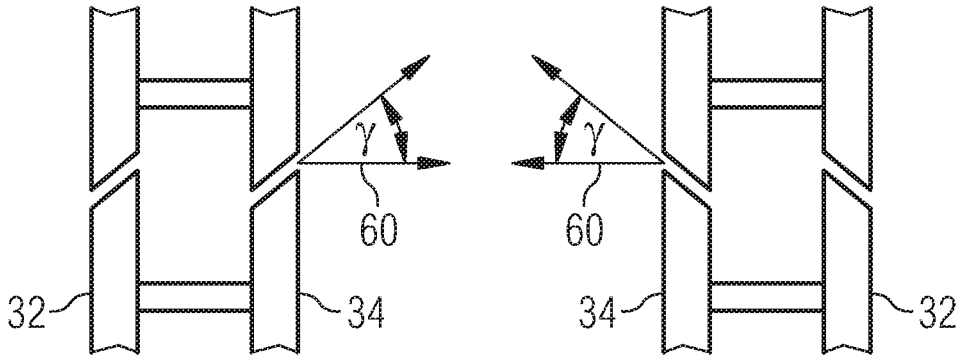
FIG. 9 is an end view of a second embodiment of the diffuser in accordance with the invention.

In a second embodiment of the invention, the teeth are cut at an angle $\alpha$=90° and also at an angle $\gamma$ in the plane of the diffuser. This is illustrated in FIG. 9 (which again shows the rings 32, 34), where the cuts are in opposite directions with respect to the radial direction 60 looking along the longitudinal axis of the diffuser. The $\alpha$=90° arrangement prevents relative axial movement, while the angle $\gamma$ prevents relative radial movement of the upper and lower diffuser halves, at least not without at the same time having to lift the upper half relative to the lower half at one of the two interfaces, due to the angle $\gamma$.

It should be noted that the arrangement of FIGS. 7 and 8 also, by default, involves the existence of the angle $\gamma$, due to the fact that angle $\alpha$<90° and $\beta$>90°. The difference in the case of FIG. 9 is that, since angle $\alpha$=90°, angle $\gamma$ would not normally exist and therefore has to be deliberately introduced.

Some measure of immunity to relative movement can be obtained if movement is restricted in only one of the two directions: axial and radial. Thus, a situation in which the teeth are cut directly along the radial direction at the interfaces, so that the angle $\alpha$ (see FIG. 7(*a*)) is 90° and the angle $\gamma$ (see FIG. 9) is 0°, will prevent axial movement, but not radial. On the other hand, a situation in which the angle $\alpha$ is 0° will prevent radial movement, but not axial. This latter situation corresponds to the forming not of teeth in the diffuser, but a tongue-and-groove-type configuration, in which a groove is made axially along each interface on one of the upper and lower diffuser halves and an interlocking projection is made axially along each interface on the other of the upper and lower diffuser halves.

Figure 10:
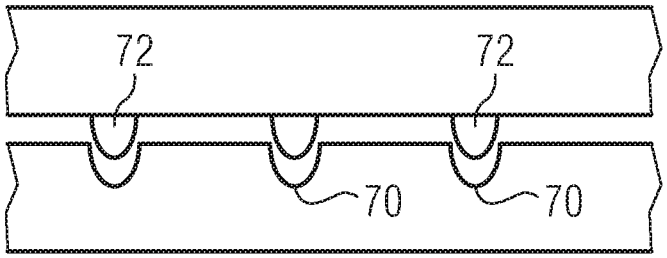
FIG. 10 illustrates another way of configuring the interface between adjacent arcuate sections of the diffuser in accordance with the invention.

The groove-and-projection arrangement just described can also be made the basis of a third embodiment of a diffuser according to the present invention. In this embodiment the teeth are replaced by a series of rounded grooves along the interface in one of the two halves, while the other half is provided with a corresponding series of protrusions, which mate with the rounded grooves. This is sometimes known as a "bird's mouth" configuration, in which the grooves form the "bird's mouth". This is illustrated in FIG. 10, where the grooves are shown as items 70 and the protrusions as items 72. A wire-EDM procedure similar to that of the first and second embodiments may have its drawbacks here, since, with the rounded form of groove and protrusion shown, a certain amount of play is created in the axial direction. This by definition allows some relative axial movement of the two diffuser halves, which is undesirable. One possible technique, however, is to create the grooves and protrusions separately. Indeed, it is feasible to employ a wire-EDM procedure to create the grooves in one diffuser-half in one operation, and then attach suitably sized protrusions to the other half. In this case the wire used should be somewhat larger than that used in the first and second embodiments, since this allows larger protrusions to be made, enabling a greater dimensioning accuracy to be achieved in the making of the protrusions.

Generally speaking, any kind of interlocking shape can be used for the interfaces, provided the result is a very limited relative movement. A shape which might not be particularly suitable, when using EDM to profile both diffuser halves, is that shown in FIG. 11. In this scenario, an EDM wire 50 is drawn along the interface in a generally axial direction, so as to form a series of castellations in the two halves of the diffuser. This creates a considerable amount of play $\delta$ in an axial direction when the two halves are mated together. This scenario is a more extreme case of the play that exists in the arrangement of FIG. 10 using the EDM technique to provide the profile in both diffuser-halves. However, the castellation shape is more feasible, where the two halves of the diffuser are made separately. In that case conventional machining methods can be employed to create the male and female halves of the castellations, the male half being increased in width in order to eliminate the play $\delta$. Alternatively, a spacer could be fitted between the male and female halves, reducing the play. However, this has the drawback that it increases the component count and complexity of the diffuser, while also incurring the risk of unwanted relative movement between the parts.

Figure 11:
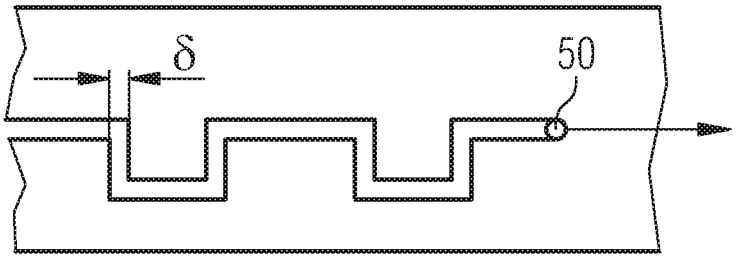
FIG. 11 shows a non-preferred way of configuring the interface between adjacent arcuate sections of the diffuser in accordance with the invention.

Although it has been assumed that the castellation shape of FIG. 11—and to a somewhat lesser extent, the bird's mouth shape of FIG. 10—is not suitable where EDM is employed to produce both diffuser-halves, this may not be true in all situations. Thus, where a very thin wire is used and the teeth/protrusions are large relative to the diameter of the wire, the play δ that is created may be very small and therefore acceptable.

The diffuser has so far been described as being a split diffuser. It may, however, take other forms within the scope of the present invention. One such alternative configuration is to dispense with the inner set of vanes 40. There would then still be two passages for the flow of fluid through the diffuser: an outer passage defined by the inner and outer rings 34, 32 and an inner passage defined by the inner ring 34 and the seal member 42 of the engine. A further alternative is to dispense with the inner vanes 40 and increase the radial length of the outer vanes 38 so that the inner ring 34 reaches to the seal member 42. This would give rise to a single passage through the diffuser. Indeed, it might even be possible to omit the seal member altogether and rely on the inner ring to define the sole passage. Alternatively, a component equivalent to the seal member could be formed at the free end of the vanes 40, the separate seal member 42 being then dispensed with. A further alternative is to dispense with the inner ring 34 and inner vanes 40 and to increase the radial length of the outer vanes 38, so that they reach the seal member 42. In these various alternative configurations the basic nature of the invention remains the same, namely the provision of a means at the interfaces between the upper and lower diffuser halves for preventing relative movement between these halves.

Although the invention has been described in terms of the division of the diffuser into two semicircular halves, the invention is not restricted to this. Hence, the diffuser may be divided into three or more arcuate sections, which engage with each other to form the ring(s). In this case teeth, or other means, will be provided at each of the interfaces between the sections. Where an opposite-angle arrangement, such as shown in FIGS. 8 and 9, is to be employed, it will be necessary to divide the diffuser into an even number of sections.

The various illustrations of the invention show serrations formed along the whole axial length of the diffuser. This is not essential to the invention, since a sufficient movement-preventing function can be realized by having serrations along only a portion of the axial length. For example, serrations could be provided at each end (i.e. upstream end and downstream end) of the diffuser, or at one end and in the middle, or in the middle only. However, greater security against relative movement of the sections of the diffuser will be obtained by having serrations at least two locations along the axial length, and preferably at each end. Furthermore, it may even be found that a single interlocking serration is all that is needed at the two or more locations, rather than multiple serrations.

When the embodiments shown in FIGS. 8 and 9 are employed, it will be convenient to make angle α or γ equal and opposite at the two interfaces. Unequal angular values, however, may be used.

It will normally be convenient, from the point of view of manufacture, to make the various arcuate sections of the diffuser equal in size. The invention envisages, however, a situation in which arcuate sections of different sizes—that is, of different arc length—are used. Furthermore, the arcuate sections may have different arc lengths at their two ends. In that case the interface between adjacent such arcuate sections will lie on a line not parallel with the longitudinal axis of the diffuser. Consequently, this means that the direction of progression of the wire through the ring in the wire-EDM process will not be in the generally longitudinal direction.

What has been described above is an easily realized solution to the problem of relative movement of the two halves of a diffuser during assembly of a gas-turbine engine. The solution involves the provision of a means (e.g. serrations) at the interfaces between the two halves for restricting such movement. Furthermore, by making the serrations at an angle to the longitudinal axis or at an angle to the radial direction of the diffuser, in the plane of the diffuser, and making this angle opposite at the two interfaces, enhanced security against relative movement can be achieved. A major benefit of this solution is the lack of any need for a separate fixing means to secure the two halves of the diffuser to each other. It avoids the use of, for example, bolts, which would be difficult to access in practice.

The invention claimed is:

1. A diffuser for decelerating a compressed fluid, comprising:

a ring arrangement, divided at a plurality of circumferential positions around the ring arrangement into a plurality of arcuate sections assembled together to form the ring arrangement, wherein the ring arrangement defines at least one passage, and wherein an interface between two adjacent arcuate sections is formed by a serrated mating surface of the two adjacent arcuate sections to prevent relative movement of the two adjacent arcuate sections, each mating surface comprising a series of identically shaped serrations that are shaped and configured to prevent relative movement of the two adjacent arcuate sections in a radial direction as well as in an axial direction.

2. The diffuser as claimed in claim 1, wherein a plurality of serrations in the serrated mating surface are configured at an angle to a longitudinal axis of the diffuser.

3. The diffuser as claimed in claim 2, wherein the ring arrangement includes two adjacent arcuate sections providing two pairs of mating surfaces located on opposite sides of the longitudinal axis, and wherein a first angle of a first plurality of peaks and troughs of the serrations in a first pair of mating surfaces with respect to the longitudinal axis is opposite to a second angle of a second plurality of peaks and troughs of the serrations in the second pair of mating surfaces with respect to the longitudinal axis.

4. The diffuser as claimed in claim 3, wherein the interfaces and the longitudinal axis lie on a same plane.

5. The diffuser as claimed in claim 4, wherein the plurality of serrations are triangular in shape.

6. The diffuser as claimed in claim 5, wherein the first angle and the second angle each lie in a range 30° to 60°.

7. The diffuser as claimed in claim 6, wherein a third angle of pitch of the plurality of serrations lies in the range 30° to 60°, the third angle being measure with respect to a radial direction.

8. The diffuser as claimed in claim 2, wherein the ring arrangement includes two adjacent arcuate sections providing two pairs of mating surfaces located on opposite sides of the longitudinal axis, wherein the angle of each of the peaks and troughs of the serrations in the two pairs of mating surfaces is 90° with respect to the longitudinal axis, and wherein the plurality of serrations are formed at an fifth angle in a plane of the diffuser.

9. The diffuser as claimed in claim 8, wherein the fifth angle lies in the range 30° to 60°.

10. The diffuser as claimed in claim 1, wherein the diffuser defines a radially outer passage and a radially inner passage.

11. The diffuser as claimed in claim 10, wherein the ring arrangement comprises a radially outer ring and a radially inner ring, wherein the radially outer passage is defined between the radially outer ring and the radially inner ring, and wherein the radially outer ring and the radially inner ring are held in place, spaced-apart, by a plurality of first vanes.

12. The diffuser as claimed in claim 11, wherein the radially inner passage is essentially defined by the radially inner ring, the radially inner passage is radially inside the radially inner ring.

13. The diffuser as claimed in claim 12, wherein a plurality of second vanes are provided, and wherein the plurality of second vanes are positioned radially inward from the radially inner ring.

14. The diffuser as claimed in claim 1, wherein the ring arrangement comprises a radially outer ring and a radially inner ring, wherein the one passage is defined between the radially outer ring and the radially inner ring, and wherein the radially outer ring and the radially inner ring are held in place, spaced-apart, by a plurality of vanes.

15. A method for producing a diffuser, comprising:

providing a complete ring arrangement; and dividing the ring arrangement into a plurality of arcuate sections by an erosion of the ring arrangement in a generally longitudinal direction, the erosion also forms a configuration of an interface between two adjacent arcuate sections at the same time as the erosion of the ring arrangement, wherein the dividing configures the interface into a plurality of mating serrations, wherein an interface between two adjacent arcuate sections is formed by a serrated mating surface of the two adjacent arcuate sections to prevent relative movement of the two adjacent arcuate sections, each mating surface comprising a series of identically shaped serrations that are shaped and configured to prevent relative movement of the two adjacent arcuate sections in a radial direction as well as in an axial direction.

16. The method as claimed in claim 15, wherein the dividing forms the configuration over essentially an entire longitudinal extent of the ring arrangement.

17. The method as claimed in claim 15, wherein the dividing forms the configuration over a portion of the longitudinal extent of the ring arrangement.

18. The method as claimed in claim 17, wherein the dividing configures the interface between the two adjacent arcuate sections as a bird's mouth arrangement.

19. The method as claimed in claim 15, wherein the dividing employs a wire electrical discharge machining procedure.

20. A gas turbine engine, comprising:

a compressor section, a combustor section located downstream of the compressor section, and a diffuser located at an exit of the compressor section and upstream of the combustor section for conditioning a compressed fluid received from the compressor section before it is fed to the combustor section, the diffuser comprising:

a ring arrangement, divided at a plurality of circumferential positions around the ring arrangement into a plurality of arcuate sections assembled together to form the ring arrangement, wherein the ring arrangement defines at least one passage, and wherein an interface between two adjacent arcuate sections is formed by a serrated mating surface of the two adjacent arcuate sections to prevent relative movement of the two adjacent arcuate sections, each mating surface comprising a series of identically shaped serrations that are shaped and configured to prevent relative movement of the two adjacent arcuate sections in a radial direction as well as in an axial direction.

* * * * *